United States Patent [19]

Takechi et al.

[11] 4,376,661

[45] Mar. 15, 1983

[54] METHOD OF PRODUCING DUAL PHASE STRUCTURE COLD ROLLED STEEL SHEET

[75] Inventors: Hiroshi Takechi, Kisarazu; Munetsugu Matsuo, Kawasaki; Kazuo Koyama, Kimitsu, all of Japan

[73] Assignee: Nippon Steel Corporation, Tokyo, Japan

[21] Appl. No.: 48,587

[22] Filed: Jun. 13, 1979

[30] Foreign Application Priority Data

Jun. 16, 1978 [JP] Japan ..... 53-72802

[51] Int. Cl.[3] ..... C21D 8/04; C21D 9/48

[52] U.S. Cl. ..... 148/12 C; 148/12.4; 148/143

[58] Field of Search ..... 148/12 C, 12 D, 12.4, 148/39, 36, 143, 156, 12.3, 12 F; 75/123 N

[56] References Cited

U.S. PATENT DOCUMENTS

| | | | |
|---|---|---|---|
| 3,857,740 | 12/1974 | Gondo et al. | 148/12 F |
| 3,914,135 | 10/1975 | Kozasu et al. | 75/123 N |
| 3,944,442 | 3/1976 | Donachie | 148/12.4 |
| 3,951,696 | 4/1976 | Gondo | 148/12 C |
| 4,011,106 | 3/1977 | Takechi et al. | 148/12 C |
| 4,033,789 | 7/1977 | Hamburg et al. | 75/123 W |
| 4,159,218 | 6/1979 | Chatfield et al. | 148/12.4 |

FOREIGN PATENT DOCUMENTS

| | | | |
|---|---|---|---|
| 839471 | 7/1976 | Belgium . | |
| 1591687 | 6/1970 | France | 75/123 N |
| 2238767 | 2/1975 | France . | |
| 2240294 | 3/1975 | France . | |
| 49-14610 | 4/1974 | Japan | 75/123 N |
| 51-42012 | 4/1976 | Japan | 148/12 D |
| 435299 | 12/1974 | U.S.S.R. | 75/123 N |
| 197712 | 12/1977 | U.S.S.R. | 148/12 C |

OTHER PUBLICATIONS

Hayami et al, "A Family of High-Strength, Cold-Rolled Steels", Micro Alloying 75, Seminar, Wed. Oct. 1, 1975, Washington, D.C., pp. 78–87.

Morrow, Journal of Metals, vol. 30, No. 3, Mar. 1978, pp. 16–19.

*Primary Examiner*—Peter K. Skiff

*Attorney, Agent, or Firm*—Cushman, Darby & Cushman

[57] ABSTRACT

A method of producing a dual phase structure cold rolled steel sheet having tensile strength 35 to 50 kg/mm$^2$, yield ratio less than 60% and high elongation which comprises hot rolling and cold rolling by conventional process a steel containing 0.01 to 0.05% C, less than 0.2% Si, 1.7 to 2.5% Mn, 0.01 to 0.10 Al with the balance being Fe and unavoidable impurities, holding the produced steel sheet for 20 seconds to 20 minutes at a temperature 720° to 850° C., and cooling the steel sheet at a cooling speed between 3° and 50° C. per second and also above a value (°C. per second) shown by following formulae:

$$12\times[Mn(\%)]^2-62\times[Mn(\%)]+81.$$

5 Claims, No Drawings

METHOD OF PRODUCING DUAL PHASE STRUCTURE COLD ROLLED STEEL SHEET

BACKGROUND OF THE INVENTION

The present invention relates to a method of producing a dual phase structure cold rolled steel sheet having low yield point, high elongation and tensile strength 35 to 50 kg/mm$^2$.

Recently, automobile plants use high strength steel sheets in place of conventional mild steel sheets (SPCC and SPCD of JIS Standard) to comply with safety and weight reduction demands. However, stretchability of steel is decreased generally as strength is increased. Thus the high strength steel can not stand a high degree of press forming, so that availability of the steel is greatly limitted.

Recently, dual phase structure high strength steel sheet which is produced by continuous annealing is proposed to mitigate above mentioned disadvantage. The dual phase structure steel sheet is described in Japanese Layed Open Patent Appln. No. 39210/75 and U.S. Pat. No. 3,951,696. As shown in the patents, steel containing Si and or Mn is heated to $\alpha$ and $\gamma$ two phase range in constitutional diagram and is cooled relatively rapidly to obtain a structure having ferrite and transformation product and frequently involves retained austenite. The produced steel sheet has high tensile strength, low yield point and high elongation. In the above mentioned Appln. No. 39210/75, a steel containing 0.02 to 0.15% C, 0.7 to 2.870 Si, 0.7 to 2.5% Mn, and the ratio Si to Mn being between 0.6 to 1.5 with the balance being Fe and unavoidable impurities is cold rolled and is heated by desired heating rate, preferably 1000° C. per minute. The steel is held at temperature 700°–910° C. for desired time, preferably less than 80 minutes and is cooled at cooling rate more than 100° C. per minute. By such dual phase structure heat treatment, high strength and high ductile cold rolled steel sheet is obtained. In the U.S. Pat. No. 3,951,696, a steel containing 0.03 to 0.30% C, less than 0.7% Si, 0.6 to 2.5% Mn, 0.01 to 0.20 Sol Al, less than 0.015 O, less than 0.012% S with the balance Fe and unavoidable impurities is hot rolled and is cold rolled with a reduction more than 30%. The steel sheet is heated at average heating rate more than 3° C. per second and is annealed for 1 to 15 minutes in a temperature range between $A_1$ and $A_3$ transformation points. Then the sheet is cooled at a cooling rate 0.5° to 30° C. per second as average cooling rate to 500° C. High strength and high elongation cold rolled steel sheet is produced.

The above mentioned dual phase structure high strength steel sheet considerably widened applicability of high strength steel for automobile plants. The steel sheet has tensile strength more than 50 kg/mm$^2$ and has low yield point and high elongation compared with high strength steel sheets of similar strength. However, the yield point is higher and the elongation is lower than those of conventional mild steel sheets. Thus, the dual phase structure steel sheets described in the above mentioned documents are not satisfactory to comply with severe demands for outer skin of automobile.

SUMMARY OF THE INVENTION

The present invention aims to widen applicability of dual phase structure steel sheet, and to provide a method of producing dual phase structure steel sheet having low yield point similar with that of mild steel sheet, tensile strength of 35 to 50 kg/mm$^2$, and higher elongation compared with conventional high strength steel sheets.

The dual phase structure steel sheet according to the present invention attains lower yield point compared with that of known dual phase structure steel sheets by combining specified constituents based on low carbon and high manganese steel, and specified continuous annealing conditions.

According to the present invention, a method of producing a dual phase structure cold rolled steel sheet having tensile strength 35 to 50 kg/mm$^2$, yield ratio less than 60% and high elongation comprises steps of hot rolling and cold rolling by conventional process a steel containing 0.01 to 0.05% C, less than 0.2% Si, 1.7 to 2.5% Mn, 0.01 to 0.10% Al, with the balance being Fe and unavoidable impurities, holding the produced steel sheet for 20 seconds to 20 minutes at a temperature 720° to 850° C., and cooling the steel sheet at a cooling rate between 3° and 30° C. per second and also above a value (°C. per second) shown by following formulae:

$$12\times[\mathrm{Mn}(\%)]^2-62\times[\mathrm{Mn}(\%)]+81.$$

The yield ratio is a percentage of yield point value divided by tensile strength value.

Preferably, the steel further contains at least one of 0.005 to 0.050% rate earth metal, 0.01 to 0.1% Zr, 0.001 to 0.02% Ca, 1.0% Cr, 0.5% Ni, 0.5% Mo and less than 0.0005 to 0.0050% B.

Preferably, the steel contains no Si as constituent.

The steel sheet according to the present invention has low yield point generally similar with that of conventional mild steel sheet, has high tensile strength of 35 to 50 kg/mm$^2$, and also has higher elongation compared with that of conventional high strength steel of similar tensile strength. Thus, the steel sheet attains the following distinct advantages.

The yield point relates directly with spring back of press forming process, and press loading is lower to process low yield point steel sheet to obtain accurately formed parts. The steel sheet according to the present invention has yield point as low as that of mild steel so that the steel sheet can very advantageously be formed by press.

The steel sheet according to the invention has elongation which is higher about a few percent than that of conventional high strength steel sheets. That means higher workability of the steel sheet according to the present invention.

Conventional steel sheets for outer skin of automobiles are generally steel sheets of 0.8 mm thickness. Recently thinner steel sheets are used to reduce total weight of automobile. In this case dent resistance which represent resistance to local denting force to steel sheet becomes important problem. The dent resistance relates to thickness and strength of steel sheet. The important reason to use high strength steel sheet to outer skin of automobile is to improve dent resistance of outer skin.

The steel sheet according to the present invention assures high workability by low yield point and high elongation and also assures high dent resistance by high strength. Thus, the high strength steel sheet according to the present invention can be used as outer skin of automobile in place of conventional mild steel sheets advantageously, to strengthen and to reduce total weight of automobile body.

DESCRIPTION OF PREFERRED EMBODIMENTS

At first, reason and delimiting reason of constructional elements of the present invention will be described.

As to chemical constituents, carbon is necessary to produce 3–30% of transformation product from $\gamma$-phase. While steel is cooled from $\alpha$–$\gamma$ two phase range. When carbon is less than 0.01% the product will not be produced. When carbon content is more than 0.05%, the transformation product is increased, and produced steel is harder than intended by the present invention so that ductility similar with mild steel sheet can not be obtained. The transformation product is composed mainly of martensite and often contains non-transformed austenite phase.

Silicon is very useful element to easily obtain dual phase structure as described Japanese Layed Open Patent Publication No. 39210/75. However, silicon is harmful element as to paintability and corrosion resistance after painting which are inevitably necessary properties for cold rolled steel sheets, especially for automobile outer panels, so that it is preferable to decrease silicon. Allowable limit is less than 0.2%, however it is preferable to delimit less than 0.05% to match severe request. It is one of the features of the present invention that dual phase structure steel suitable for automobile outer panels is obtained without silicon which is suitable element to obtain dual phase structure steel.

Manganese is one of the most important constituents according to the present invention. Manganese increases hardenability of $\gamma$ phase to obtain a transformation product during the cooling process, and increases ductility by strengthening the ferrite base. The hardenability is not sufficient when manganese is below 1.7%, and the effect is saturated when manganese is above 2.5%. Also, it is difficult to add manganese above 2.5% by the usual converter steel manufacturing process.

Al is necessary for de-oxidation of the steel, and the deoxidation is not sufficient when Al content is less than 0.01%. When Al content is more than 0.10%, ductility of steel is harmed by increasing alumina inclusion.

Rare earth metals, Zr and Ca spheroidize sulfide inclusion in the steel and supplementarily increases ductility, so that one or more elements are contained in the steel. The lower limits to attain the effect of the rare earth metals, Zr and Ca are 0.005%, 0.01% and 0.001% respectively, and upper limits to saturate the effect are 0.050%, 0.1% and 0.02% respectively.

Cr, Ni, Mo and B increase hardenability of $\gamma$ phase so that supplementary effect to Mn is obtained. Thus, one or more elements selected from Cr, Ni, Mo and B may be included as necessary.

The upper limits of the contents of the elements are decided regarding from saturation of effect or compromise between economy and effect. The lower limits are determined by the effect desired.

The manufacturing process of the steel according to the present invention is by continuous annealing process after hot rolling and cold rolling operations. As to the annealing condition, it is necessary to perform recrystallization of cold rolled ferrite phase to obtain $\alpha$–$\gamma$ two phase state. To attain the conditions, lower limit temperature of 720° C. is necessary. When the temperature is more than 850° C., volume ratio of $\gamma$ phase in the $\alpha$–$\gamma$ two phase state is increased, C and Mn concentrations in the $\gamma$ phase are decreased, hardenability of the $\gamma$ phase is decreased, and desired dual phase structure can not be obtained. When annealing time is less than 20 seconds, sufficient $\gamma$ phase transformation can not be obtained, and when the time is more than 20 minutes, distribution of the $\gamma$ phase is too coarse, and too coarse transformation product results from coarse $\gamma$ phase grain. To obtain most suitable volume ratio and distribution between $\alpha$ and $\gamma$ phases, heating between 30 seconds and 5 minutes at 730°–800° C.

To obtain desired transformation product, cooling rate is very important. When the cooling rate is less than 3° C. per second, desired transformation product can not be obtained. When the cooling rate is more than 50° C. per second, ductility decreases too much. The low ductility may result from decreasing the remaining austenite phase in the transformation product. Moreover, when the cooling rate is too fast, the steel strip is distorted, the yield point is increased and ductility is decreased by plastic deformation caused by correction by skin pass rolling, so that the advantages of the dual phase structure steel is reduced. The upper limit of the cooling rate is determined by above-mentioned two reasons. Especially from the latter reason, the cooling rate may preferably be limited to less than 30° C. per second. The cooling rate is average cooling rate from 700° C. to 300° C.

It is necessary to determine the cooling rate regarding from hardenability of $\gamma$ phase in relation to constituents. The inventors of the present invention ascertained from many experiments that the lower limit of the cooling rate is shown by following experimental formulae.

$$\text{Lower limit of the cooling rate (°C. per second)} = 12\times[\text{Mn}(\%)]^2 - 62\times[\text{Mn}(\%)] + 81$$

When Mn is 1.5, the cooling rate is more than 15° C. per second, and when Mn is 2.0%, the cooling speed is more than 5° C., regarding hardenability of $\gamma$ phase.

The effects and delimiting conditions of the constituents according to the present invention are described as follows. Hot rolling operation and cold rolling operation are usual operations. As to coiling temperature of hot rolled strip, high temperature coiling of 730° C.–800° C. to determine two phase before cold rolling, to improve dispersion of C and Mn to $\gamma$ phase while two phase range annealing.

Annealing process of the present invention is performed by continuous annealing equipment. However, such conventional continuous annealing equipments are made for mild steel strips so that overaging furnace is established after the continuous annealing equipment. In the present invention, overaging treatment which promotes separating of carbide metallurgically is harmful, so that the overaging furnace should be sufficiently cool to prevent steel from overaging, when the steel strip according to the present invention inevitably passes the overaging furnace.

Some examples will be described.

EXAMPLE 1

Table 1 shows chemical compositions, annealing conditions and mechanical properties of steels to be tested. The steels were produced in a converter and decarburized by vacuum degassing. The steels were cast and bloomed, then hot rolled into steel strips of 2.7 mm thickness. The hot roll finishing temperature were 910° C., and coiling temperature were 750° C. Then the strips were pickled and cold rolled into 0.8 mm thickness. The finished steel strips were continuously annealed.

In the Table 1, Nos. 1–3 and 8 are collations. Steel No. 1 corresponds to manufacturing method of Japanese Layed Open Patent Appln. No. 39210/75, and steel No. 2 corresponds to that of Japanese Layed Open Patent Appln. No. 98419/75. Steel No. 3 is known phosphorus added steel used as high strength steel sheets of tensile strength in the range of 40–50 kg/mm$^2$. Steel No. 8 is aluminum killed steel for conventional mild steel sheets. Steels Nos. 4, and 7 are steels according to the present invention. Steel No. 6 has same composition with the steel No. 5, however cooling speed is changed for the purpose of collation. To the steels Nos. 3–8, Si is not added during the steel producing process. As to annealing conditions, the steels were maintained for two minutes at 750° C., and cooled at a cooling speed of 10° C. per second or 3° C. per second.

As shown in Table 1, steels according to the present invention have low yield points which are generally similar with conventional mild steel sheet i.e. the steel No. 8 and is substantially lower from conventional high strength steel for same purpose i.e. steel No. 3. Elongation of the steels Nos. 4, 5 and 7 according to the present invention are improved a few percents from the collation steel No. 3. Thus, the cold rolled steel sheets according to the present invention are expected to have improved workability from the improved elongation and yield point, and also to have improved dent resistability.

EXAMPLE 2

Importance of annealing condition will be described. Table 2 shows mechanical properties by changing annealing and cooling conditions of the steel No. 4 shown in the Table 1. Effects of annealing temperatures are shown in Nos. A–C, and effects of cooling speeds are shown in Nos. D and E. In the No. A, annealing temperature is not reached to desired two phase range temperature, and in the No. C, annealing temperature is too high to reach single $\gamma$ phase range. In the No. D, cooling speed is too low, and in the No. E, cooling speed is too high. As shown in No. B, annealing and cooling conditions according to the present invention result in high tensile strength, low yield point and high elongation steel sheet.

TABLE 1

| | | chemical composition | | | | | | contenuous annealing condition | | | mechanical properties (JIS No. 5) | | | | |
|---|---|---|---|---|---|---|---|---|---|---|---|---|---|---|---|
| | | C | Si | Mn | P | Al | others | annealing condition | average cooling rate from 700° C. to 300° C. (°C./sec) | skin pass | yield point (Kg/mm$^2$) | tensile strength (Kg/mm$^2$) | elongation (%) | yield ratio (%) | 12[Mn(%)]$^2$ − 62[Mn(%)] + 81 |
| 1 | collation | 0.10 | 1.23 | 1.37 | 0.018 | 0.029 | No | 750° C. × 2 min | 10 | 0.5 | 41.1 | 76.9 | 24 | 53 | 18.6 |
| 2 | collation | 0.08 | 0.48 | 1.61 | 0.023 | 0.036 | No | 750° C. × 2 min | 10 | 0.5 | 35.9 | 55.6 | 32 | 65 | 12.3 |
| 3 | collation | 0.07 | 0.02 | 0.36 | 0.133 | 0.040 | No | 750° C. × 2 min | 10* | 1.0 | 30.5 | 47.1 | 33 | 65 | 60.2 |
| 4 | invention | 0.028 | 0.04 | 2.11 | 0.022 | 0.027 | No | 750° C. × 2 min | 10* | 0.5 | 18.1 | 47.3 | 37 | 38 | 3.6 |
| 5 | invention | 0.036 | 0.04 | 1.80 | 0.014 | 0.031 | No | 750° C. × 2 min | 10* | 0.5 | 20.3 | 49.0 | 36 | 41 | 7.8 |
| 6 | collation | 0.036 | 0.04 | 1.80 | 0.014 | 0.031 | No | 750° C. × 2 min | 3 | 0.5 | 27.1 | 44.3 | 34 | 61 | 7.8 |
| 7 | invention | 0.030 | 0.03 | 1.75 | 0.014 | 0.031 | REM 0.018 Cr 0.28 | 750° C. × 2 min | 10 | 0.5 | 19.7 | 46.8 | 37 | 42 | 9.3 |
| 8 | collation | 0.043 | 0.01 | 0.35 | 0.015 | 0.044 | No | 750° C. × 2 min | 10* | 1.0 | 20.8 | 32.1 | 42 | 65 | 60.8 |

*Overaging treatment is applied at 450° C. for 10 minutes while cooling and average cooling rate is from 700° C. to 450° C.
REM means rare earth metals.

TABLE 2

| | annealing condition temperature (°C.) × time (min) | average cooling rate from 700° C. to 300° C. (C/S) | Mechanical Properties (JIS No. 5) yield point (Kg/mm$^2$) | tensile strength (Kg/mm$^2$) | elongation (%) | yield ratio (%) |
|---|---|---|---|---|---|---|
| A | 700° C. × 2 min. | 10 | 26.4 | 39.1 | 37 | 68 |
| B | 750° C. × 2 min. | 10 | 18.1 | 47.3 | 37 | 38 |
| C | 920° C. × 2 min. | 10 | 25.3 | 42.3 | 34 | 60 |
| D | 750° C. × 30 min. | 0.01 | 25.0 | 36.3 | 38 | 69 |
| E | 750° C. × 2 min. | 200 | 30.9 | 52.2 | 25 | 59 |

Skin pass is 0.5%.

The steel according to the present invention may be produced by conventional ingot casting process or by continuous casting process. The steel may be produced by vacuum degassing process which may be desired process e.g. DH process or RH process. The continuous annealing equipment may be any desired equipment which satisfies annealing conditions according to the present invention. As the continuous annealing equipment, conventional continuous melt zinc plating equipment to obtain zinc plated steel sheets.

What is claimed is:

1. A method of producing a dual phase structure cold rolled steel sheet having tensile strength 35 to 50 kg/mm$^2$, yield ratio less than 60% and high elongation comprising steps of hot rolling and cold rolling by conventional process a steel containing 0.01 to 0.05% C, less than 0.2% Si, 1.7 to 2.5% Mn, 0.01 to 0.10% Al with the balance being Fe and unavoidable impurities, holding the produced steel sheet for 20 seconds to 20 minutes at a temperature 720° to 850° C., and cooling the steel sheet at a cooling rate between 3° and 30° C. per second and also above a value (°C. per second) shown by following formulae:

$$12\times[Mn(\%)]^2-62\times[Mn(\%)]+81.$$

2. A method according to claim 1 wherein the cooling rate is 10° C. per second.

3. A method according to claim 2 wherein the steel sheet produced is held at 750° C. for 2 minutes.

4. A method of producing a dual phase structure cold rolled steel sheet having tensile strength 35 to 50 kg/mm$^2$, yield ratio less than 60% and high elongation comprising steps of hot rolling and cold rolling by conventional process a steel containing 0.01 to 0.05% C, less than 0.2% Si, 1.7 to 2.5% Mn, 0.01 to 0.10% Al, and at least one of 0.005 to 0.050% rare earth metal, 0.01 to 0.1% Zr, 0.001 to 0.02% Ca, less than 1.0% Cr, less than 0.5% Ni, less than 0.5% Mo, and 0.0005 to 0.0050% B with the balance being Fe and unavoidable impurities, holding the produced steel sheet for 20 seconds to 20 minutes at a temperature 720° to 850° C., and cooling the steel sheet at a cooling rate between 3° and 30° C. per second and also above a value (°C. per second) as shown by following formulae:

$$12\times[Mn(\%)]^2-62\times[Mn(\%)]+81.$$

5. A method as claimed in claim 1 or 4, in which said steel contains no Si as constituted.

* * * * *

UNITED STATES PATENT AND TRADEMARK OFFICE

CERTIFICATE OF CORRECTION

PATENT NO. : 4,376,661

DATED : March 15, 1983

INVENTOR(S) : TAKECHI, H.; MATSUO, M.; and KOYAMA, K.

It is certified that error appears in the above-identified patent and that said Letters Patent is hereby corrected as shown below:

Claim 5, last line the word "constituted" should read --constituent--.

Signed and Sealed this

Sixth Day of September 1983

[SEAL]

*Attest:*

GERALD J. MOSSINGHOFF

*Attesting Officer*

*Commissioner of Patents and Trademarks*